US006296704B1

(12) United States Patent
Yamazaki

(10) Patent No.: US 6,296,704 B1
(45) Date of Patent: Oct. 2, 2001

(54) DIP COATING APPARATUS

(75) Inventor: Junichi Yamazaki, Shizuoka (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 09/277,225

(22) Filed: Mar. 26, 1999

(30) Foreign Application Priority Data

Mar. 27, 1998 (JP) ..... 10-100269

(51) Int. Cl.[7] ..... B05C 3/00
(52) U.S. Cl. ..... 118/429; 118/423; 118/63
(58) Field of Search ..... 118/425, 423, 118/429, 63

(56) References Cited

FOREIGN PATENT DOCUMENTS

| | | |
|---|---|---|
| 59-127049 | 7/1984 | (JP) . |
| 59-225771 | 12/1984 | (JP) . |
| 63-7873 | 1/1988 | (JP) . |
| 1-107874 | 4/1989 | (JP) . |
| 3-213171 | 9/1991 | (JP) . |
| 4-29773 | 1/1992 | (JP) . |
| 5-7812 | 1/1993 | (JP) . |
| 5-88385 | 4/1993 | (JP) . |
| 9-218524 | 8/1997 | (JP) . |
| 9-218525 | 8/1997 | (JP) . |
| 9-265193 | 10/1997 | (JP) . |
| 9-325506 | 12/1997 | (JP) . |
| 10-20525 | 1/1998 | (JP) . |

*Primary Examiner*—Brenda A. Lamb
(74) *Attorney, Agent, or Firm*—Oblon, Spivak, McClelland, Maier & Neustadt, P.C.

(57) ABSTRACT

In a dip coating apparatus including a jig having a function of generating a stream of air flowing downward toward the surface of a coating liquid stored in a bath, and causing the jig to hold a base to be coated and dip it in the coating liquid, the bath includes a lid having an opening whose inside diameter is equal to or greater than the inside diameter of the opening of the bath. The apparatus is capable of forming a uniform film free from roughness on the surface of a desired base, e.g., a photoconductive element for electrophotography.

3 Claims, 4 Drawing Sheets

Fig. 6

| | MAX THICKNESS | MIN THICKNESS | MEAN THICKNESS | DIFFERENCE BETWEEN MAX & MIN |
|---|---|---|---|---|
| EXAMPLE | 31.1μm | 29.1μm | 30.1μm | 2.0μm |
| COMPARATIVE EXAMPLE | 32.2μm | 27.5μm | 30.5μm | 4.7μm |

DIP COATING APPARATUS

BACKGROUND OF THE INVENTION

1. Field of the Invention

The present invention relates to a dip coating apparatus and more particularly, to a dip coating apparatus including a jig having a function of generating a stream of air directed downward toward the surface of a coating liquid stored in a bath and causing the jig to hold a base to be coated and dip it in the liquid for forming a film on the base.

2. Discussion of the Background

A dip coating method is extensively used to coat a hollow cylindrical base with a liquid for forming a photoconductive element. The problem with the dip coating method is that a film formed on the base sags and becomes thinner at the upper end portion of the member, at which coating begins, than the other portion. While various methods have heretofore been proposed for obviating sagging, they need sophisticated coating apparatuses, often render the resulting films irregular in thickness, and cannot fully obviate sagging.

Japanese Patent Laid-Open Publication No. 59-127049, for example, teaches a method which reduces the vapor of a solvent produced from a photoconductive coating liquid when a hollow cylindrical base is lifted out of the liquid. This method, however, needs an exclusive air passage mounted on the top of a bath for reducing the density of the above vapor and is not practicable without resorting to a complicated coating apparatus. Moreover, because air is caused to flow toward the base sideways, it hits against the base in a particular manner at each of the upstream side and downstream side and is apt to render the resulting film irregular.

Japanese Patent Laid-Open Publication 59-225771 discloses a method using an annular air doctor positioned above the surface of a coating liquid stored in a bath. A stream of air is sent from the air doctor to a hollow cylindrical base when the base is lifted out of the liquid. This also renders the resulting film irregular due to the disturbance to the stream of air inside the bath and the stream of air directly hitting against the film.

Japanese Patent Laid-Open Publication No. 63-7873 teaches an arrangement in which a flexible hood is positioned on the top of a bath for sequentially reducing the density of vapor downward. This kind of arrangement is not practical without resorting to a complicated apparatus.

Japanese Patent Laid-Open Publication No. 1-107874 teaches that air is caused to flow horizontally when a hollow cylindrical base is lifted. This also has the problem stated in relation to the above Laid-Open Publication No. 59-127049.

Japanese Patent Laid-Open Publication No. 3-213171 proposes a method that blows, when a hollow cylindrical base is lifted, air swirling in the circumferential direction above a bath. This method also needs a complicated apparatus and is apt to render the resulting film irregular because air hits against the base.

Further, Japanese Patent Laid-Open Publication No. 4-29773 discloses a method which blows air from a nozzle in a direction tangential to a hollow cylindrical base when the base is lifted. This air, however, causes a liquid to flow on a part of the base against which air hits, also rendering the resulting film irregular.

In addition, Japanese Patent Laid-Open Publication Nos. 57812, 5-88385, etc. propose various methods for solving the sagging problem. These methods, however, each need a complicated apparatus and is apt to result in an irregular film.

As for a photoconductive element for electrophotography, use is often made of a coating liquid containing methylene chloride or similar chloric solvent. Chloric solvents, however, are harmful to the environment in various ways, e.g., ozone-unfriendly and should not be used wherever possible. Considering the solubility of binder resin and safety, there can be used only a small number of solvents including tetrahydrofurane as a solvent for a photoconductive coating liquid. However, such solvents have a problem that their boiling points are lower than the boiling points of chloric solvents customary with photoconductive elements. As a result, the resulting film needs a long period of time to dry and sags more than the conventional film at its upper portion.

Further, when the photoconductive element is applied to a printer or a facsimile apparatus by way of example, the photoconductive film formed thereon wears due to repeated operation and reduces the service life of the element. In light of this, it has been proposed to use a wear resistant, high-molecular substance as the resin component of the photoconductive film or to provide a charge transfer layer with wear resistance by polymerization. This kind of scheme, however, increases the viscosity of the coating liquid if the density of a solid component is the same as the conventional density. Should the density of a solid component be reduced, the liquid would noticeably sag in the upper portion of the film.

Japanese Patent Laid-Open Publication No. 9-265193 discloses a dip coating apparatus constructed to obviate the irregularity of the film on the base and the sagging of the liquid in the upper portion of the film. The dip coating apparatus includes a jig for holding the base and including an air outlet implemented by a cylindrical porous body. Air sent from the air outlet is caused to flow downward toward the surface of a coating liquid. Even this kind of apparatus renders a film formed on the base irregular or rough when applied to the production of a photoconductive element for electrophotography.

SUMMARY OF THE INVENTION

It is therefore an object of the present invention to provide a dip coating apparatus capable of forming a film free from irregularity or roughness on a hollow cylindrical base and advantageously applicable to the production of a photoconductive element for electrophotography.

In accordance with the present invention, in a dip coating apparatus including a jig having a function of generating a stream of air flowing downward toward the surface of a coating liquid stored in a bath, and causing the jig to hold a base to be coated and dip it in the coating liquid, the bath including a lid having an opening whose inside diameter is equal to or greater than the inside diameter of the opening of the bath.

BRIEF DESCRIPTION OF THE DRAWINGS

The above and other objects, features and advantages of the present invention will become more apparent from the following detailed description taken with the accompanying drawings in which:

FIG. 6 is a table comparing Example of the present invention and Comparative Example with respect to the thickness of a charge transfer layer.

DESCRIPTION OF THE PREFERRED EMBODIMENT

Figure 1:
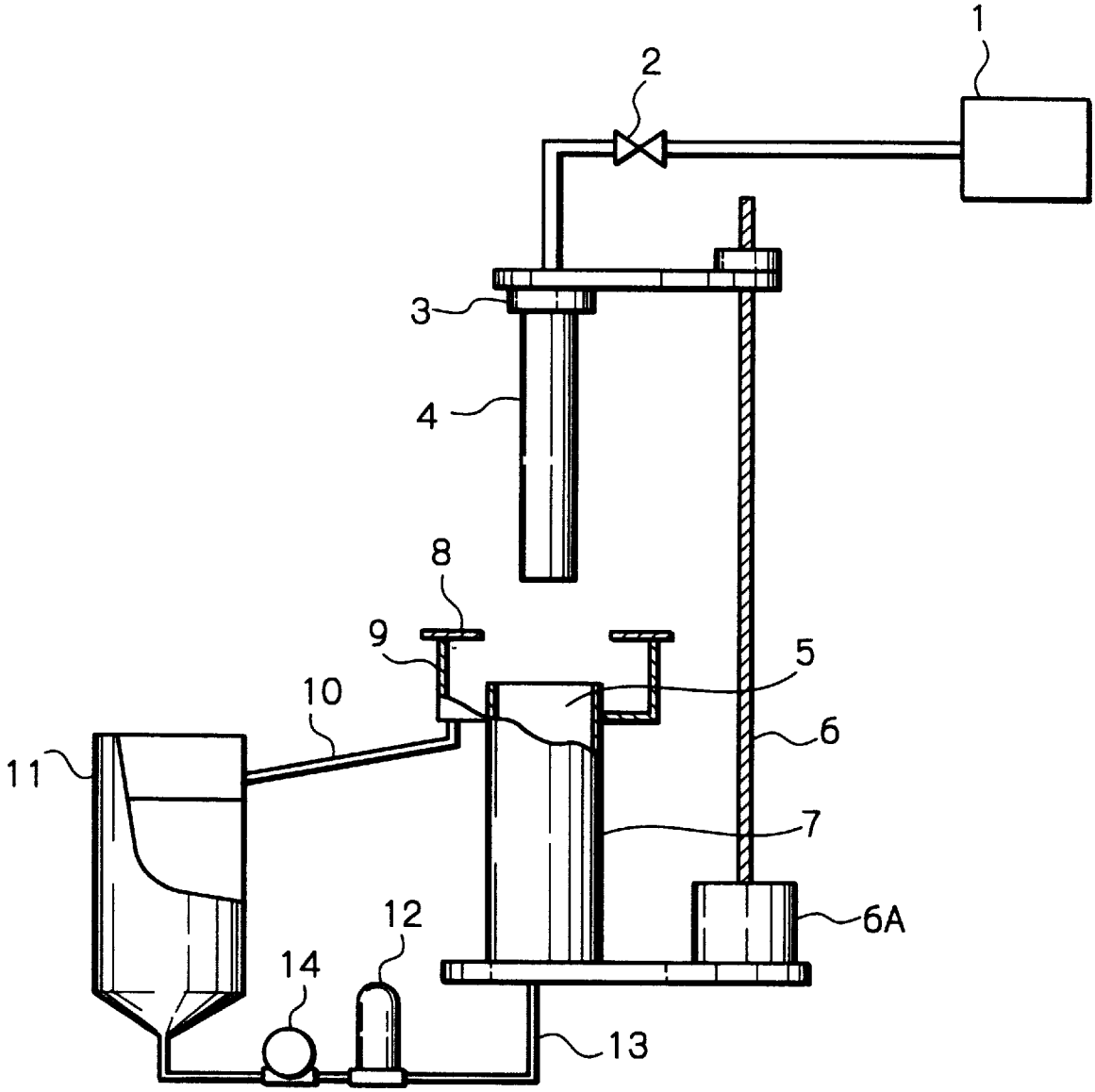
FIG. 1 is a sectional view showing a dip coating apparatus embodying the present invention.

Referring to FIG. 1 of the drawings, a dip coating apparatus embodying the present invention is shown and includes an air source 1 and a control valve 2. A jig 3 holds a hollow cylindrical base 4 to be coated and has a function of generating a stream of air flowing down toward the surface of a coating liquid 5 stored in a bath container 7. A return conduit 10 commnicates the bath 7 to a liquid collecting tank 11 while a feed conduit 13 communicates the tank 11 to the bath 7 via a circulation pump 14 and a filter 12. There are also shown in FIG. 1 a ball screw 6, an elevation motor 6A, a lid 8, and a liquid collecting chamber 9. The lid 8 is formed with an opening greater in inside diameter than the opening of the bath 7. The elevation motor 6A is driven to move the base 4 held by the jig 3 upward or downward along the ball screw 6.

The base 4 is dipped in the liquid 5 stored in the bath 7 and coated therewith, as follows. After the base 4 has been hold by the jig 3, the elevation motor 6A is driven to lower the jig 3 and therefore the member 4 via the ball screw 6 until the base 4 has been dipped in the liquid 5. While the base 4 is so lowered, the control valve 2 is opened to feed compressed air from the air source 1 to the jig 3. As a result, compressed air flows downward from the jig 3 toward the surface of the liquid 5 stored in the bath 7. With such a stream of air, it is possible to control the density of a solvent vaporized from the surface of the liquid 5 and to promote the vaporization of the solvent. The vaporization of the solvent successfully increases the density of a solid component contained in the liquid 5.

Subsequently, the motor 6A is driven to raise the jig 3 supporting the base 4. As a result, the liquid 5 is applied to the surface of the base 4 in the form of a film.

While the jig 3 may having air communicated therethrough any time during the above coating procedure, it is most effective to send it when the base 4 is lowered into the liquid 5. Alternatively, the jig 3 may communicate air therethrough when the base 4 is dipped in the liquid 5 to a preselected deepest position or when the base 4 is raised away form the liquid 5.

The liquid 5 overflows the bath 7 during the above operation and is collected in the tank 11 via the liquid collecting chamber 9. After the base 4 has been coated with the liquid 5, the circulation pump 14 is driven to recirculate the liquid 5 from the tank 11 to the bath 7. At this instant, the liquid 5 in the tank 11 is stirred and adjusted in terms of viscosity. In addition, an apparatus, not shown, adjusts the temperature and viscosity of the liquid 5 while uniforming the liquid 5.

Figure 2:
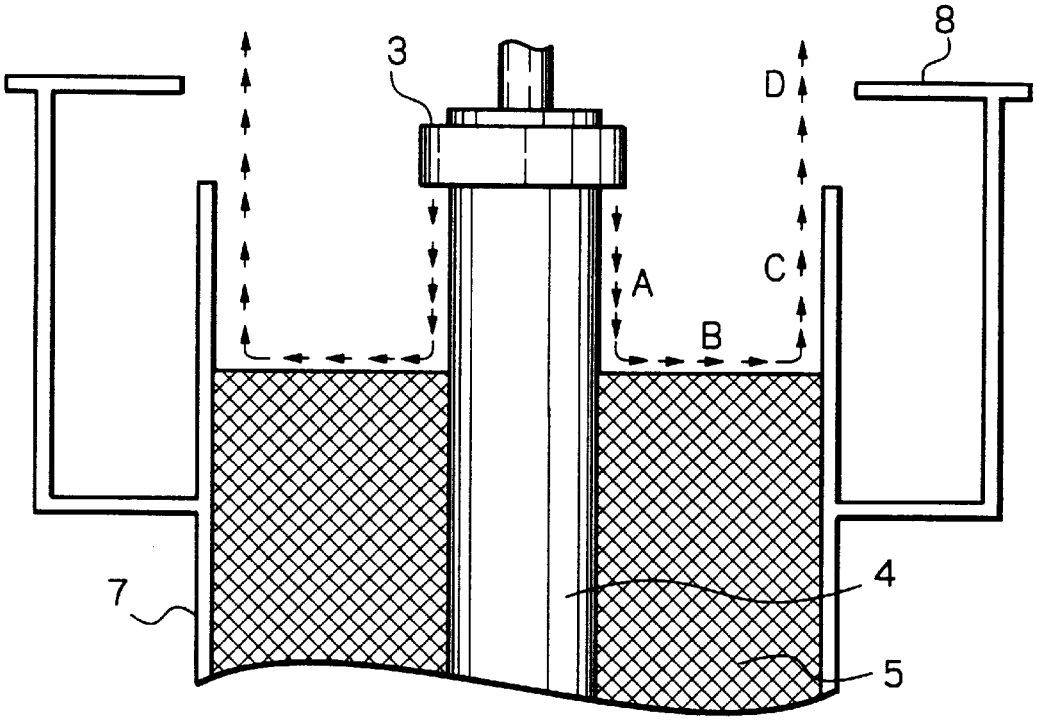
FIG. 2 is a sketch showing how a stream of air sent from a jig included in the illustrative embodiment flows downward toward the surface of a coating liquid.

FIG. 2 shows how the air stream sent from the jig 3 toward the liquid 5 stored in the bath 7 flows. As shown, the base 4 hold by the jig 3 is dipped in the liquid 5 via the opening of the lid 8 that is greater in inside diameter than the opening of the bath 7. While the base 4 is so lowered into the bath 7, the jig 3 sends air received from the air source 1, FIG. 1, generating a downward stream of air A.

The stream A flows downward along the base 4 and then spreads horizontally outward along the surface of the liquid 5, as represented by a stream B. Then, the stream B turns out a stream C flowing upward along the wall of the bath 7. Because the opening of the lid 8 is greater in inside diameter than the opening of the bath 7, the stream C turns out a stream D flowing upward without being obstructed by the lid 8. This is also true when the opening of the lid 8 has the same inside diameter as the opening of the bath 7.

The above consecutive streams A–D are free from disturbances in the vicinity of the base 4 and therefore allow the base 4 to be coated with a uniform film free from roughness.

The maximum difference in inside diameter between the bath 7 and the lid 8 may be 20 mm. The difference should preferably range from 5 mm to 10 mm. While the opening of the lid 8 and that of the bath 7 should preferably be coaxial, they do not have to be coaxial so long as the lid 8 does not obstruct the air stream.

Of course, the illustrative embodiment may be modified to coat a plurality of members 4 with the liquid 5 at the same time.

When the illustrative embodiment is applied to the production of a photoconductive element for electrophotography, the liquid 5 for forming a charge transfer layer may be implemented by, e. g., bisphenol A type polycarbonate or bisphenol Z type polycarbonate. Further, use may be made of a liquid consisting of resin or similar high-molecular compound, a charge transferring agent and a solvent, a liquid consisting of a polymer of a charge transferring agent and a solvent, a liquid consisting of a polymer made up of a high-molecular compound and a charge transferring agent and a solvent, a liquid consisting of a polymer made up of a high-molecular compound and a charge transferring agent and a solvent. For the solvent, use may be made of methylene chloride or similar halogen solvent, toluene or similar aromatic solvent, or tetrahydrofurane, dioxane or similar cyclic ether solvent.

Figure 3:
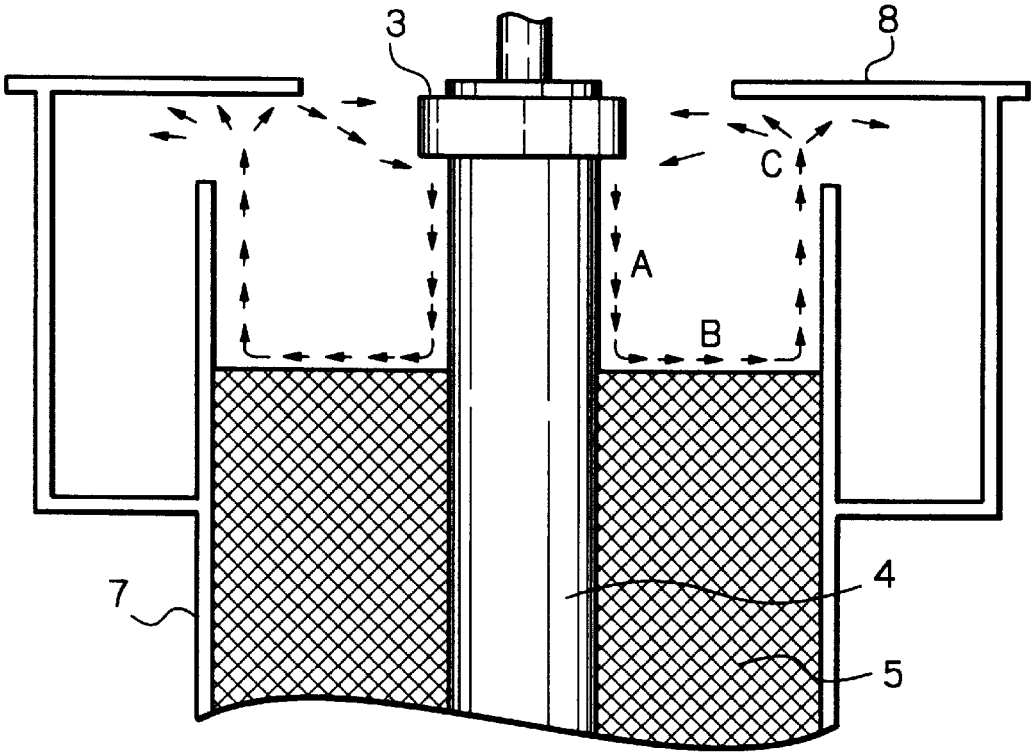
FIG. 3 is a sketch showing for comparison a stream of air sent from a jig when a lid mounted on a bath has an opening smaller in inside diameter than the opening of the bath

For comparison, FIG. 3 shows a stream of air flowing from the jig 3 toward the surface of the liquid 5 via the lid 8 whose opening is smaller in inside diameter than the opening of the bath 7. As shown, although the stream sequentially flows in the form of the consecutive streams A and B up the surface of the liquid 5, it is obstructed by the lid 8 when flowing upward in the form of the stream C. As a result, the stream is disturbed around the base 4 and renders a film formed on the base 4 irregular or rough. The disturbance to the stream is more noticeable when a plurality of bases 4 are treated at the same time.

An example of the present invention and a comparative example will be described hereinafter.

EXAMPLE (1) In the dip coating apparatus shown in FIG. 1, the opening of the bath 7 had an inside diameter of 60 mm while the opening of the lid 8 had an inside diameter of 55 mm. An under layer and a charge transfer layer were sequentially formed on a hollow cylindrical aluminum base having an outside diameter of 30 mm, a thickness of 250 mm and a length of 250 mm as follows.

To form an under layer, 5 parts by weight of soluble nylon Aramine (trade name) available from Toray Industries, Inc. was dissolved in 95 parts by weight of methanol to prepare an under layer liquid. The base was dipped in the under layer liquid and then dried at 100° C. for 10 minutes to form a 0.3 $\mu$m thick under layer.

Figure 4:
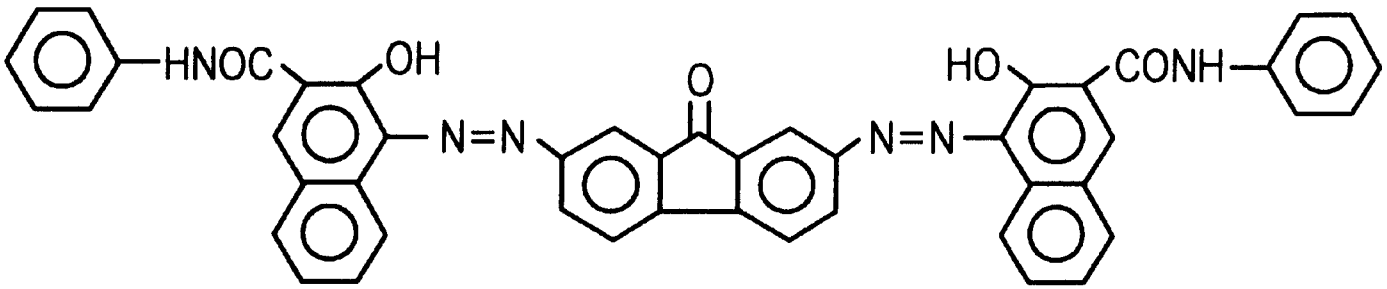
FIGS. 4 and 5 show formulae respectively representative of a charge generating agent and a charge transferring agent used in the illustrative embodiment.

Subsequently, 10 parts by weight of charge generating agent represented by a formula shown in FIG. 4, 7 parts by weight of polyvinyl butyral and 145 parts by weight of tetrahydrofurane were introduced in a ball mill and milled for 72 hours. 200 parts by weight of cyclohexane was added to the mixture, and the resulting mixture was dispersed for 1 hour. Further, additional cyclohexane was introduced in the mixture as a diluent to thereby prepare a liquid for forming a charge generating layer.

The base with the under layer was dipped in the above liquid and then dried at 100° C. for 10 minutes to form a 0.1 μm thick charge generating layer.

(2) In the dip coating apparatus shown in FIG. 1, the inside diameter of the opening of the bath 7 and that of the lid 8 were 60 mm and 70 mm respectively. A charge transfer layer was formed on a hollow cylindrical aluminum base carrying the above charge generating layer, as follows.

Figure 5:
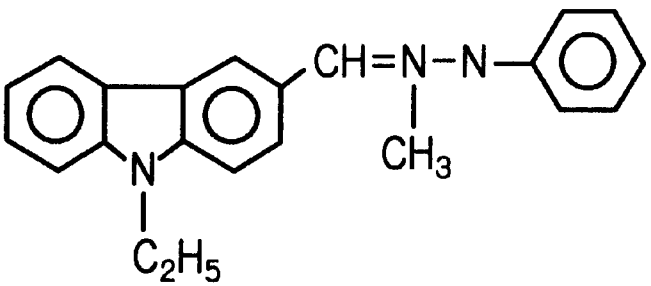

To form the charge transfer layer, 7 parts by weight of charge transferring agent represented by a formula shown in FIG. 5 and 10 parts by weight of polycarbonate Panlight C-1400 (trade name) available from TEIJIN LTD. were dissolved in 83 parts by weight of tetrahydrofurane.

Subsequently, the base with the charge generating layer was held by the jig 3 and then dipped in the above liquid stored in the bath 7 at 24° C. When the base was lowered, the control valve 2 was opened to send nitrogen gas from the jig 3 toward the surface of the liquid 5 at a flow rate of 100 ml/sec. The temperature around the apparatus was 22±1° C. The temperature of the nitrogen gas was also 22±1° C.

The base was dipped in the liquid over its entire coating range and then lifted out of the liquid by the elevation motor 15. As a result, a charge transfer layer was formed on the charge generating layer. The base was removed from the jig 3, dried at 130° C. for 30 minutes, and then naturally cooled off in a dark place.

The three photoconductive elements produced by the above experimental procedures each were subjected to measurement as to the thickness of the charge transfer layer by use of an electronic micrometer HFT-50 (trade name) available from ANRITSU CORP. Specifically, each photoconductive element was measured at the intervals of 10 mm over a range of 20 mm to 50 mm, as measured from the top toward the bottom, and at four circumferentially spaced positions. FIG. 6 lists the maximum thickness, minimum thickness, mean thickness, and a difference between the maximum and minimum thicknesses.

COMPARATIVE EXAMPLE

The example was repeated to produce three photoconductive elements except that the inside diameter of the bath 7 and that of the lid 8 were 60 mm and 55 mm, respectively. FIG. 6 also lists the thicknesses of charge transfer layers measured with the three photoconductive elements.

As FIG. 6 indicates, the Comparative Example is inferior to Example in irregularity in the thickness of the film, i.e., the uniformity of the film.

In summary, it will be seen that the present invention provides a dip coating apparatus capable of forming a uniform film free from roughness on the surface of a desired base. The apparatus can therefore implement a photoconductive element having a uniform film free from roughness.

Various modifications will become possible for those skilled in the art after receiving the teachings of the present disclosure without departing from the scope thereof.

What is claimed is:

1. A dip coating apparatus, which comprises:

a jig for holding a base to be coated, said jig having an air stream device for generating a stream of air flowing downward toward and away from a surface of a coating liquid stored in a bath container which is included as part of a bath member, and causing said jig to dip said base in said coating liquid, wherein said bath member further includes a liquid collecting chamber member and a lid connected to said chamber member, said lid being spaced from said bath container and having an opening whose inside diameter is equal to or greater than an inside diameter of an opening of said bath container whereby the flow of air away from said surface of said the coating liquid through said opening of said lid occurs without obstruction.

2. An apparatus as claimed in claim 1, wherein a difference in inner diameter between that of said bath container and the lid opening is from 5–20 mm.

3. An apparatus as claimed in claim 2, wherein a difference in inner diameter between that of said bath container and the lid opening is from 5–20 mm.

* * * * *